US006499938B1

(12) United States Patent
Pesetsky

(10) Patent No.: US 6,499,938 B1
(45) Date of Patent: Dec. 31, 2002

(54) METHOD FOR ENHANCING PART LIFE IN A GAS STREAM

(75) Inventor: David Samuel Pesetsky, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/973,987

(22) Filed: Oct. 11, 2001

(51) Int. Cl.[7] ..... F01D 9/06
(52) U.S. Cl. ..... 415/1; 415/115; 416/95
(58) Field of Search ..... 415/1, 115; 416/1, 416/97 R, 95

(56) References Cited

U.S. PATENT DOCUMENTS 4,292,008 A * 9/1981 Grosjean et al. ..... 415/115
4,571,935 A * 2/1986 Rice ..... 60/39.05

* cited by examiner

*Primary Examiner*—Edward K. Look
*Assistant Examiner*—Ninh Nguyen
(74) *Attorney, Agent, or Firm*—Nixon & Vanderhye

(57) ABSTRACT

The life of a downstream part disposed in a hot gas stream having a cooling medium injected into the stream through multiple orifices in a first upstream part is enhanced by changing the location, configuration or direction of flow of the cooling medium through the orifices. This change alters the temperature distribution of the flow field, affecting the second downstream part thereby enhancing its life. Properties of the cooling medium may also be changed, i.e., temperature and/or mass flow, to alter the temperature distribution of the flow field affecting the second downstream part to enhance its part life.

8 Claims, 6 Drawing Sheets

METHOD FOR ENHANCING PART LIFE IN A GAS STREAM

BACKGROUND OF THE INVENTION

The present invention relates to a method for enhancing the life of a downstream part disposed in a gas stream into which a cooling medium is injected through orifices of a first part upstream of the second downstream part.

The life of parts exposed in a hot gas stream is very sensitive to the flow field temperature profile boundary conditions. For example, the life of turbine buckets mounted on a turbine wheel is a function of not only the average temperature to which the buckets are exposed but to the temperature distribution of the gas stream seen by the buckets. As will be appreciated, a hot gas stream of combustion products flows through nozzles and then the buckets of the various stages of a turbine. Typically, the hot gases of combustion ate cooled by a cooling medium ejected into the hot gas stream through multiple orifices in the nozzle vanes. The orifices may be located along the leading edges, as well as the suction and pressure sides of the nozzle stator vanes, and conventionally are interspersed between the hub and tip portions of the nozzle vanes.

Flowing cooling air through orifices such as in nozzle stator vanes is a conventional method used to control the metal temperature and life of the part containing the orifices. That is, designers of parts exposed to extreme conditions such as the high temperatures of the hot gas path in a gas turbine normally control local part life by providing orifices in that part and flowing a cooling medium through the orifices and about the part. The life of parts downstream from the part containing the cooling medium orifices is typically not considered in efforts to cool the upstream part.

BRIEF SUMMARY OF THE INVENTION

In accordance with a preferred embodiment of the present invention, the life of a downstream part exposed in a hot gas stream is in part controlled by changing the location, configuration or direction of the flow of the cooling medium through the orifices, or by changing the properties of the cooling medium, such as mass flow and coolant temperature, to alter the temperature distribution of the flow field affecting the downstream part to enhance its part life. For example, the cooling medium ejected through orifices in an upstream part creates a flow field with a particular temperature distribution surrounding the downstream part. The downstream part life is affected by the resulting temperature field. Consequently, by locating, configuring or directing the flow of the cooling medium through the orifices, the temperature distribution of the flow field affecting the second part can be favorably altered to increase its part life. That is, the temperature distribution affecting the life of the downstream part is enhanced by appropriate design of the upstream injection characteristics of the cooling medium into the gas stream.

More particularly, in the case of a stage of a turbine where the nozzle vanes have orifices for flowing cooling medium into the hot gas stream, the location, configuration and/or direction of the orifices are changed to provide a desired temperature distribution of the flow field downstream in which the second part is situate to enhance the part life. For example, leading edge orifices of the nozzle vane can be directed generally radially outwardly whereby the temperature profile distribution of the gas flow seen by the downstream buckets is lower at the bucket tip than at the bucket hub. With orifices directed generally radially inwardly, the converse is true, i.e., the downstream temperature profile becomes hub strong. The effect is more pronounced because the primary stream flow has low momentum in the area of cool air injection. As a consequence, the downstream parts, e.g., buckets, are exposed to a temperature profile distribution amenable to enhanced part life. Many other useful applications will occur to those of skill in this art, including sizing end wall purges for leakages to manipulate the temperature seen by downstream parts.

As a further example of controlling the life of a downstream part exposed in a hot gas stream, the properties of the cooling medium such as mass flow and coolant temperature can be changed. Rather than change the location, configuration or direction of the flow through orifices, the flow through the orifices can be changed to alter the downstream part life. Temperature flow through the upstream orifices can be changed, for example, by supplying the cooling medium from a different stage of the compressor. The life of the downstream part may thus be enhanced, while maintaining adequate cooling of the upstream part. Mass flow through the upstream orifices likewise can be changed, with similar results.

In a preferred embodiment according to the present invention, there is provided in a method of enhancing the life of a second downstream part exposed in a gas stream having a cooling medium injected therein through multiple orifices in a first part upstream of the second downstream part, comprising the steps of (a) ascertaining a temperature distribution of a flow field of the gas stream affecting the part life of the second part and (b) changing the location, configuration or direction of flow of the cooling medium through the orifices to alter the ascertained temperature distribution of the flow field affecting the second part thereby to enhance the life of the second part.

In a further preferred embodiment according to the present invention, there is provided a method of enhancing the life of a second downstream part exposed in a gas stream having a cooling medium injected therein through multiple orifices in a first part upstream of the second downstream part, comprising the steps of (a). ascertaining a temperature distribution of a flow field of the gas stream affecting the part life of the second part and (b) changing a flow characteristic of the cooling medium including, by altering one of the temperature and mass flow of the cooling medium through the orifices to alter the ascertained temperature distribution of the flow field affecting the second part thereby to enhance the life of the second part.

DETAILED DESCRIPTION OF THE INVENTION

Figure 1:
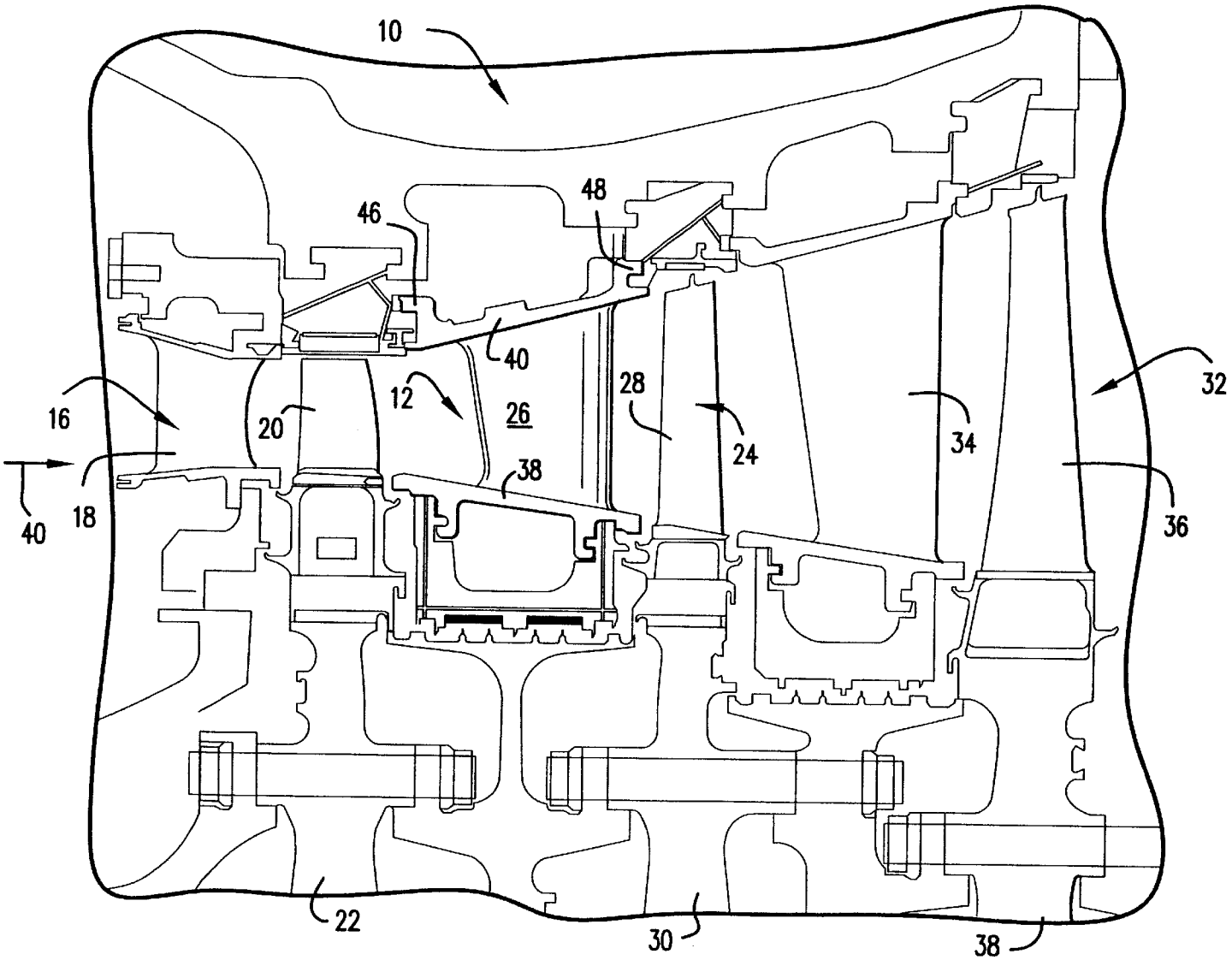
FIG. 1 is a schematic illustration of a turbine having a plurality of stages employing an embodiment of the present invention.

Referring now to FIG. 1, there is illustrated a portion of a turbine, generally designated 10, having a plurality of stages. Each stage includes a plurality of stator vanes having an airfoil shape spaced circumferentially one from the other about a rotor axis. The illustrated turbine 10 includes three stages, a first stage 16 having a plurality of circumferentially spaced nozzle vanes 18 and buckets 20 circumferentially spaced about a rotatable turbine wheel 22; a second stage 24 comprising a plurality of circumferentially spaced nozzles vanes 26 and a plurality of circumferentially spaced buckets 28 mounted on a second stage wheel 30 and a third stage 32 mounting nozzle vanes 34 and a plurality of circumferentially spaced buckets 36 mounted on a third stage wheel 38. It will be appreciated that the nozzle vanes and buckets lie in the hot gas path of the turbine and which gases flow through the turbine in the direction of the arrow 40.

Figure 2:
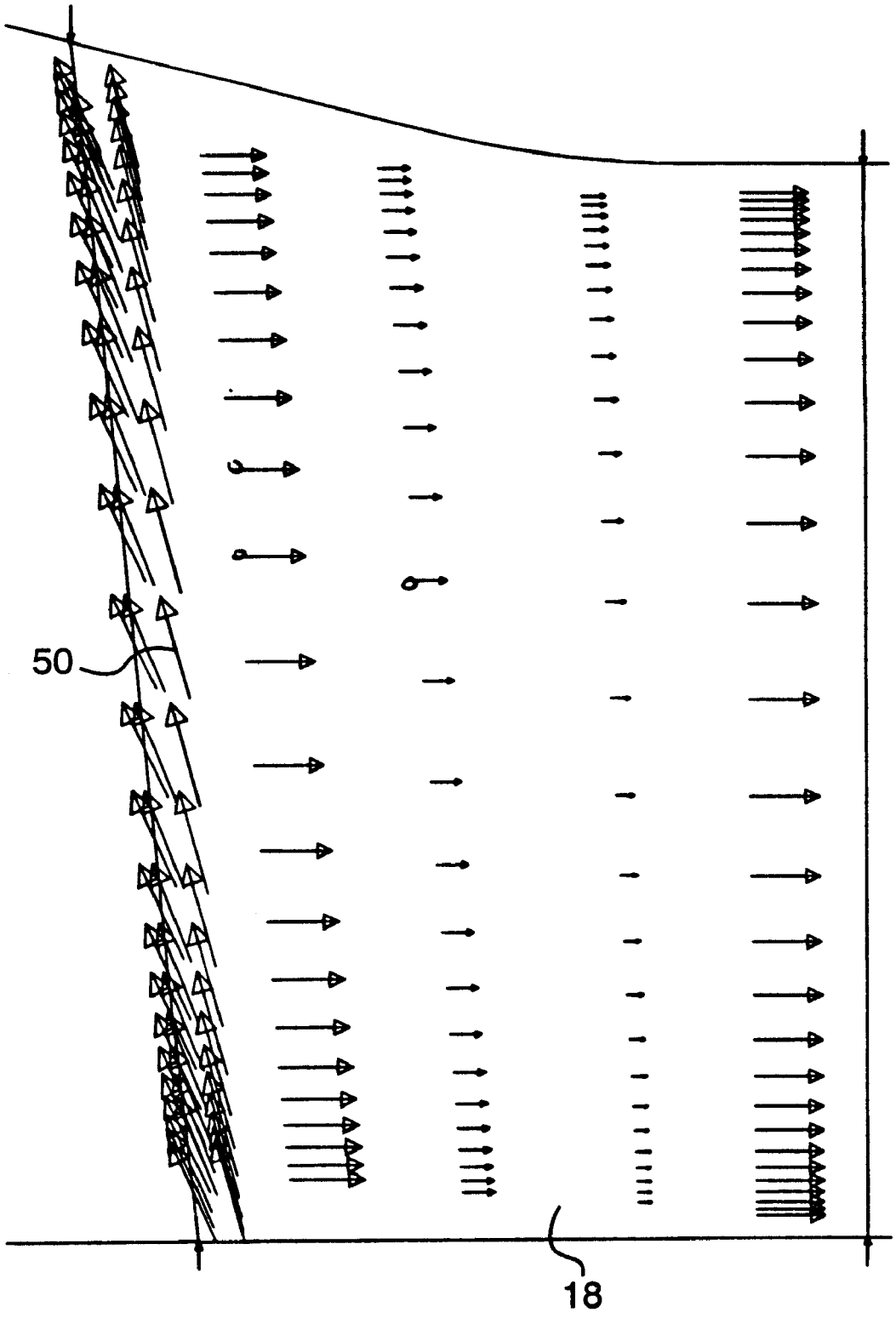
FIG. 2 is a schematic side elevational view of the pressure side of a stator vane having a plurality of orifices for flowing a cooling medium.
Figure 3:
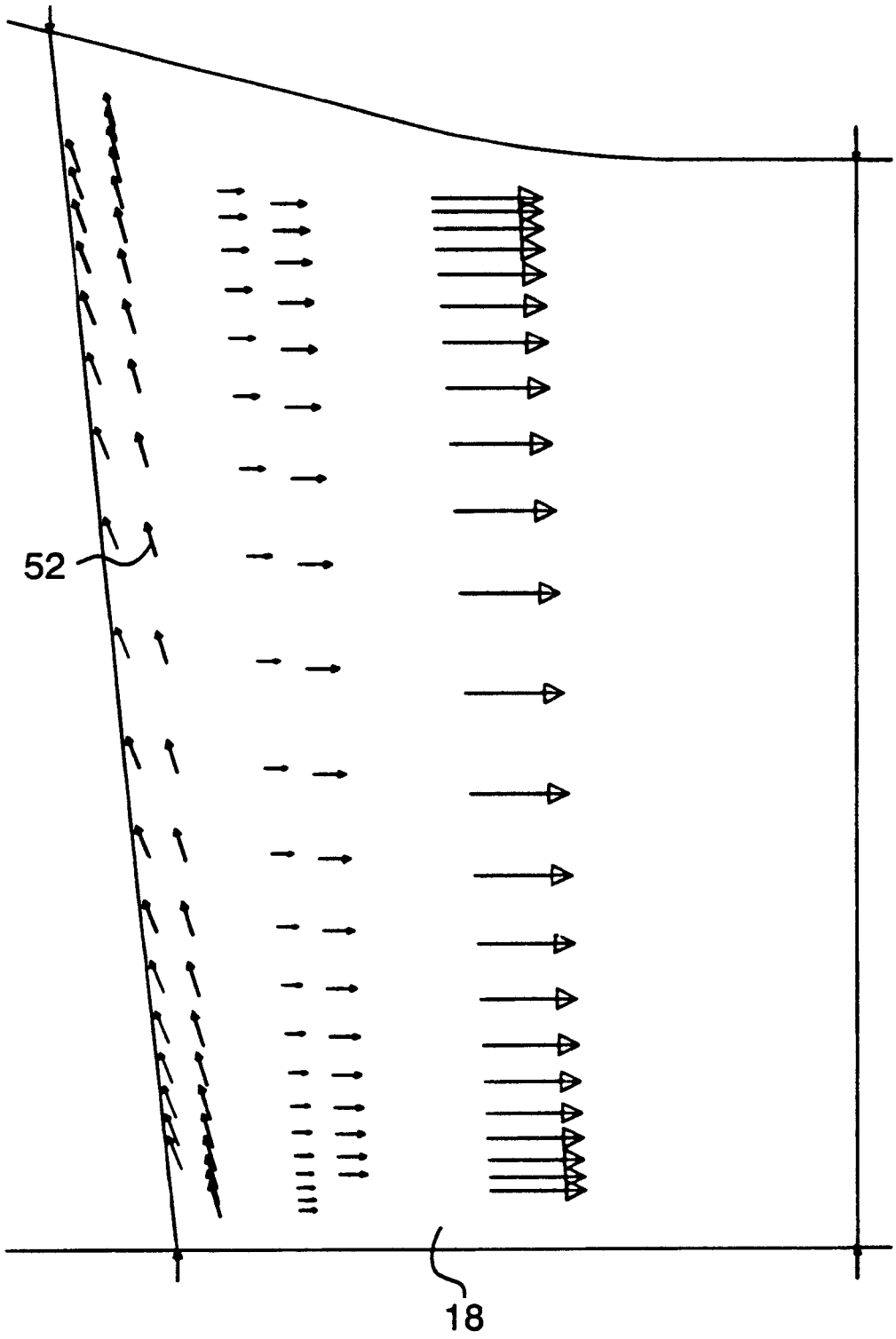
FIG. 3 is a view similar to FIG. 2 illustrating the suction side of the stator vane having orifices for flowing the cooling medium.

Referring to FIGS. 2 and 3, any one of the nozzle vanes of any one of the various stages of the turbine is schematically illustrated, e.g., the vane 18. As conventional, nozzle vanes are often provided with orifices for flowing a cooling medium, e.g., cooling air, outwardly through the orifices into the hot gas stream for purposes of cooling the nozzle vanes and particularly the metal directly adjacent the orifices and the sides of the nozzle vanes. It will be appreciated that when the cooling medium flows into the gas stream, a temperature distribution profile is provided downstream of the nozzle vanes and is "seen" by the following buckets. With the orifices directed substantially normal to the local surface of the nozzle vane at the respective orifices, the flow streamlines are generally axial and parallel to one another upon exiting the orifices. Also, the temperature profile generally appears as a horizontally extending parabola with the hottest temperatures in the midsection of the span of the stator vane.

Because the life of parts downstream of the stator vane, e.g., the buckets, is a function of the temperature seen by the buckets and other parameters, the life of the downstream part can be enhanced, in accordance with a preferred form of the present invention, by creating a flow field for the downstream part with a particular temperature distribution. To accomplish this, the orifices, e.g., the cooling and leakage ejection ports, are formed deliberately to influence the downstream flow field temperature distribution and, consequently, the downstream part life. For example, the leading edge orifices for flowing the cooling medium may be directed in a radially outward direction. The arrows 50 and 52 in FIGS. 2 and 3 represent the direction of the orifices on pressure and suction sides of the vane. Consequently, the downstream temperature distribution as seen by the buckets is different than the temperature distribution afforded by conventional nozzles cooling orifices having orifices generally normal to the surface of the nozzle vane.

Figure 4:
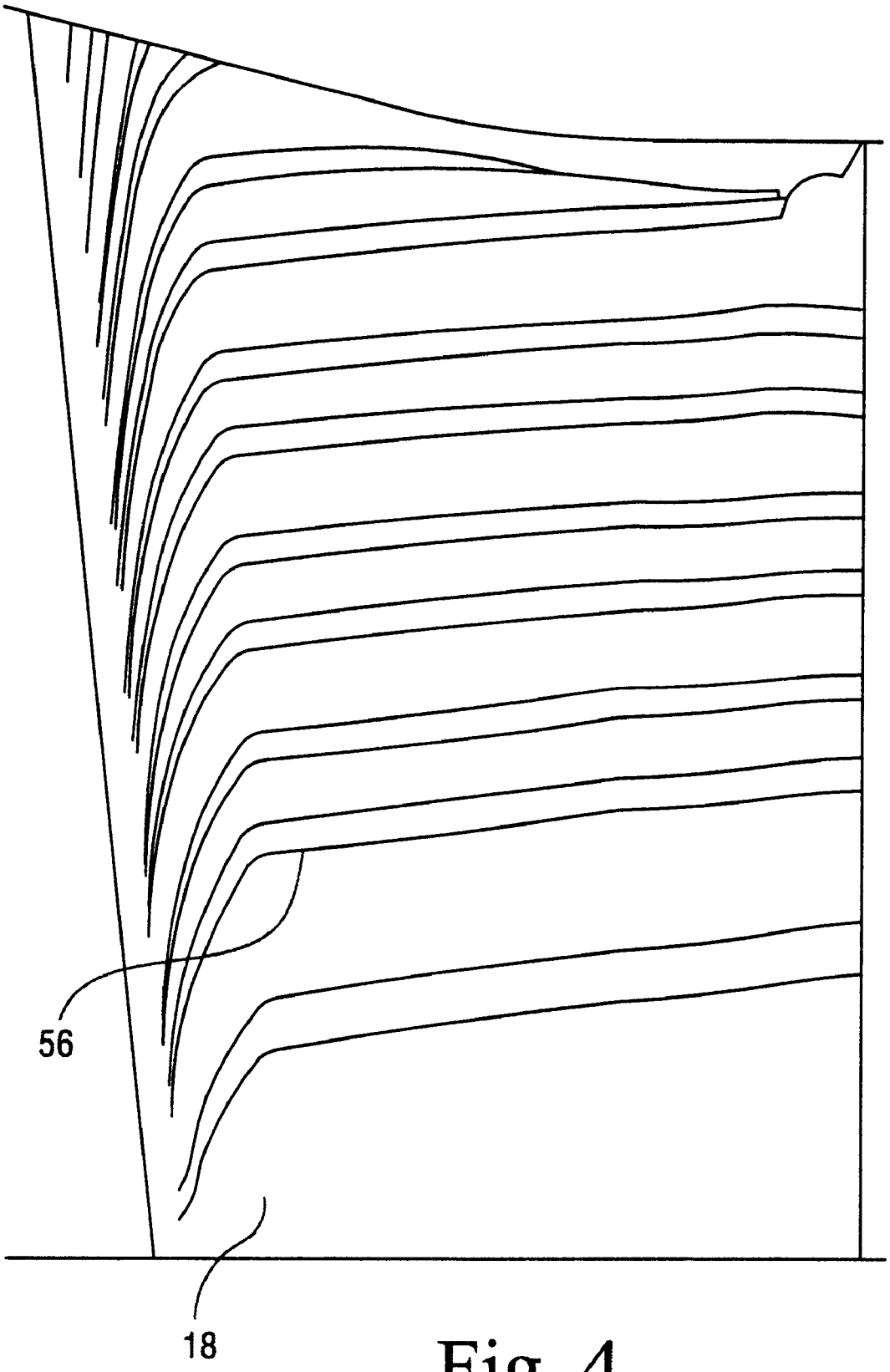
FIG. 4 is a schematic illustration of a side of a stator vane with cooling medium flow directed toward the tip of the vane as illustrated by streamlines.
Figure 5:
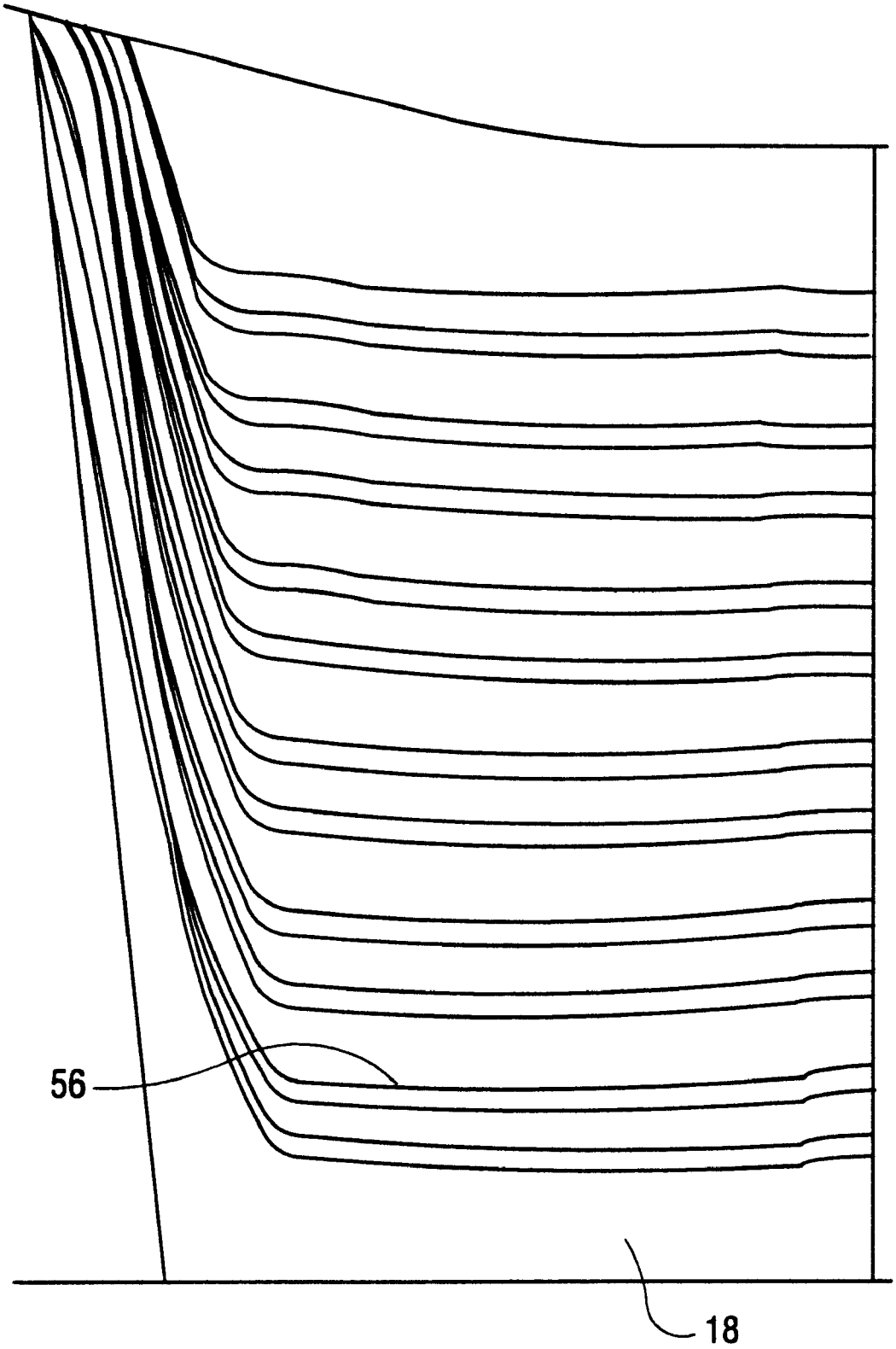
FIG. 5 is a view similar to FIG. 4 illustrating the flow of cooling medium in a direction toward the hub.
Figure 6:
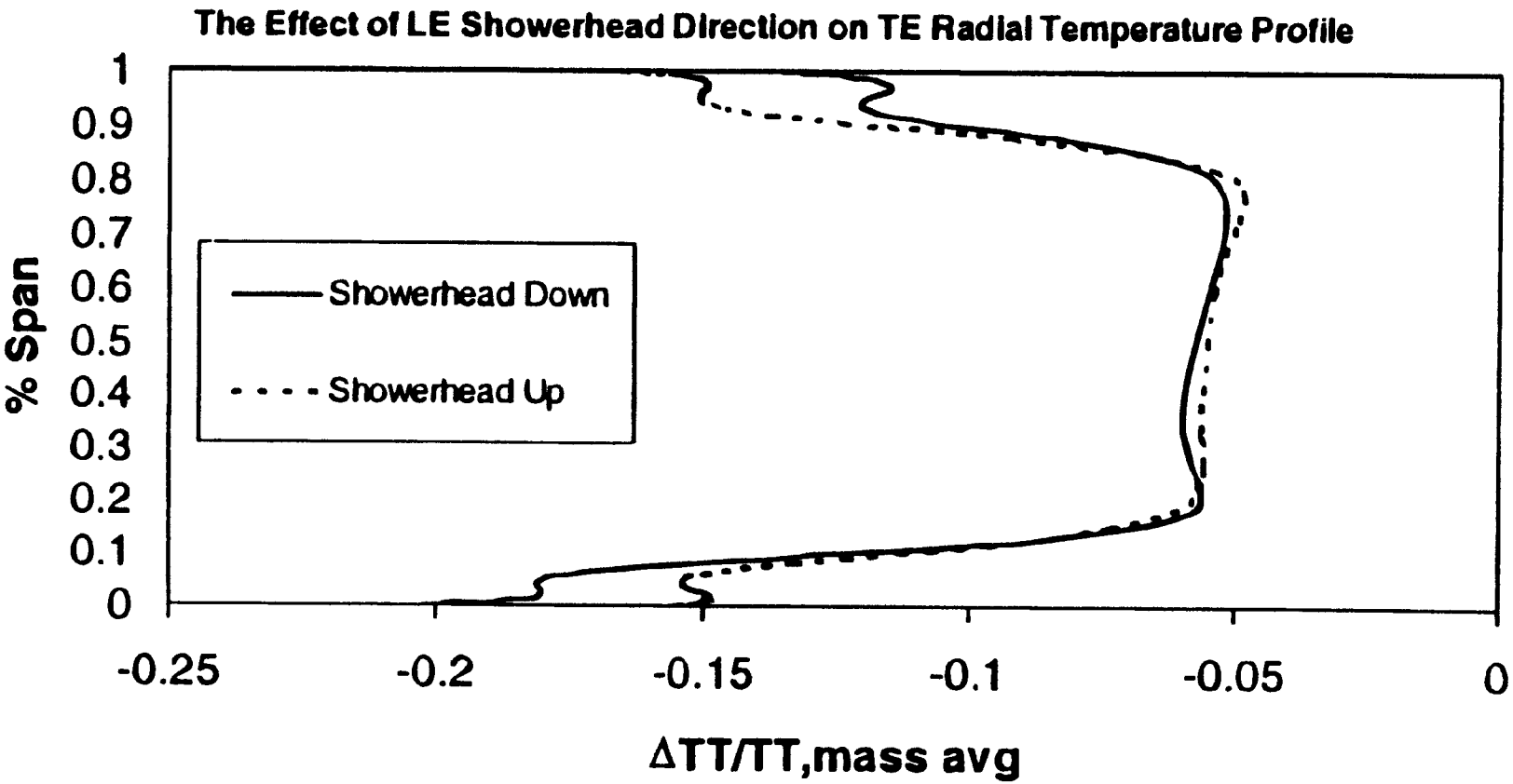
FIG. 6 is a graph illustrating the effect of changing the configuration, location and/or direction of the orifices on the temperature distribution profile as a function of the span.

Referring to FIG. 6, there is illustrated a graph having percent span, i.e., percent span at the exit of a stator vane along the ordinate, and the distribution of the change in total temperature divided by the mass average temperature along the abscissa. The graph illustrates a downstream temperature distribution by changing the direction and/or configuration of the orifices and, hence, the cooling medium flow into the gas stream as it affects the downstream part. For example, as will be seen from a review of FIGS. 2, 3, 4 and 6, the orifices along the leading edge of the nozzle vane are angled to direct the flow and hence the flow streamlines 56 (FIG. 4) in a radial outward direction toward the tip (showerhead up). FIG. 6 reveals that, with this flow distribution, the temperature profile of the downstream part is decreased along the tip and increased along the hub. Conversely, referring to FIGS. 5 and 6, it will be appreciated that by changing the configuration and/or direction of the cooling medium flow through the orifices in a radial inward direction toward the hub as illustrated by the streamlines 56 in FIG. 5 (showerhead down), the temperature profile of the downstream part is reversed, i.e., the temperature distribution of the downstream part increases at the tip and decreases at the hub. The locations of the orifices can also be changed to affect downstream part life. For example, a greater concentration of orifices can be located adjacent the tip or hub of the vanes to affect the downstream temperature distribution. Because the temperature distribution profile affects part life, and can be changed by altering the location, configuration or direction of the flow of cooling medium into the gas stream, it will be appreciated that the part life of the downstream component can be enhanced.

A similar result obtained by altering the location, configuration or direction of the flow of the cooling medium through the upstream orifices can also be achieved by changing the properties of the cooling medium, such as mass flow and coolant temperature flowing through the upstream orifices. For example, to change the temperature profile seen by the downstream part, e.g., buckets, the cooling medium for flow through the upstream orifices can be extracted from a different stage of the compressor. The mass flow can also be similarly changed. Consequently, not only can the location, configuration or direction of cooling medium flow through the orifices be changed to enhance the part life of the downstream part, but the properties of the cooling medium per se can be altered to enhance downstream part life.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of enhancing the life of a second downstream part exposed in a gas stream having a cooling medium injected therein through multiple orifices in a first part upstream of the second downstream part, comprising the steps of:

(a) ascertaining a temperature distribution of a flow field of the gas stream affecting the part life of the second part; and (b) changing the location, configuration or direction of flow of the cooling medium through the orifices to alter the ascertained temperature distribution of the flow field affecting the second part thereby to enhance the life of said second part.

2. A method according to claim 1 wherein the first part comprises a stator vane and the second part comprises a bucket of a turbine stage.

3. A method according to claim 1 including flowing the cooling medium through orifices in the leading edge of the stator vane.

4. A method according to claim 3 including directing the flow of cooling medium through the orifices generally toward an outer band of the stage.

5. A method according to claim 3 including directing the flow of the cooling medium through the orifices generally toward an inner band of the turbine stage.

6. A method according to claim 1 wherein said first part is a non-rotational component of a turbine and said second part is a rotational component of the turbine.

7. A method according to claim 1 wherein said first and second parts are spaced from one another.

8. A method of enhancing the life of a second downstream part exposed in a gas stream having a cooling medium injected therein through multiple orifices in a first part upstream of the second downstream part, comprising the steps of:

(a) ascertaining a temperature distribution of a flow field of the gas stream affecting the part life of the second part; and (b) changing a flow characteristic of the cooling medium including, by altering one of the temperature and mass flow of the cooling medium through the orifices to alter the ascertained temperature distribution of the flow field affecting the second part thereby to enhance the life of the second part.

* * * * *

UNITED STATES PATENT AND TRADEMARK OFFICE

CERTIFICATE OF CORRECTION

PATENT NO. : 6,499,938 B1
DATED : December 31, 2002
INVENTOR(S) : Pesetsky

It is certified that error appears in the above-identified patent and that said Letters Patent is hereby corrected as shown below:

Column 1,
Line 19, change “ate” to -- are --.

Signed and Sealed this

Seventeenth Day of June, 2003

JAMES E. ROGAN
*Director of the United States Patent and Trademark Office*